US009394731B2

(12) United States Patent
Buckner

(10) Patent No.: US 9,394,731 B2
(45) Date of Patent: Jul. 19, 2016

(54) DOOR LOCK SYSTEM FOR DEBRIS TANK

(71) Applicant: Don M. Buckner, Okahumpka, FL (US)

(72) Inventor: Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 80 days.

(21) Appl. No.: 14/044,984

(22) Filed: Oct. 3, 2013

(65) Prior Publication Data

US 2015/0096234 A1 Apr. 9, 2015

(51) Int. Cl.

| | |
|---|---|
| ***B65D 43/26*** | (2006.01) |
| ***E05C 19/00*** | (2006.01) |
| ***E05B 65/00*** | (2006.01) |
| ***E05C 5/04*** | (2006.01) |

(52) U.S. Cl.

CPC ..... *E05C 19/00* (2013.01); *E05B 65/001* (2013.01); *E05C 5/04* (2013.01); *Y10T 292/0864* (2015.04); *Y10T 292/1099* (2015.04)

(58) Field of Classification Search

CPC ..... B65F 1/1615; B65F 2001/1676; B65F 2240/118; B65F 2240/162; E02F 9/0891; E02F 3/8816; F17C 1/00; F17C 2205/0311; E02D 29/1427; F16J 13/16; F16J 13/12; B65D 43/164; B65D 43/163; B65D 43/16

USPC ..... 220/235, 243, 244, 211

See application file for complete search history.

(56) References Cited

U.S. PATENT DOCUMENTS

| | | | | |
|---|---|---|---|---|
| 2,448,838 | A * | 9/1948 | Sohnlein | 220/251 |
| 4,510,714 | A | 4/1985 | Kasper | |
| 5,437,516 | A * | 8/1995 | Sauerwein et al. | 404/2 |
| 6,615,849 | B1 * | 9/2003 | Gilman et al. | 134/22.18 |
| 7,213,481 | B2 * | 5/2007 | Watanabe et al. | 74/393 |
| 7,381,145 | B2 * | 6/2008 | Watanabe et al. | 475/221 |
| 7,837,050 | B2 | 11/2010 | Maybury, Jr. | |
| 8,066,140 | B1 * | 11/2011 | Young et al. | 220/263 |
| 8,360,260 | B2 | 1/2013 | Maybury, Jr. | |
| 8,628,657 | B1 * | 1/2014 | Robillard et al. | 210/163 |
| 8,925,753 | B2 * | 1/2015 | Maybury, Jr. | 220/211 |
| 2013/0134163 | A1 | 5/2013 | Maybury, Jr. | |

* cited by examiner

*Primary Examiner* — Katherine Mitchell
*Assistant Examiner* — Abe Massad
(74) *Attorney, Agent, or Firm* — Matthew G. McKinney, Esq.; Allen, Dyer, Doppelt, Milbrath & Gilchrist, P.A.

(57) ABSTRACT

A door lock system for a debris tank is disclosed. The system includes a door, a threaded bolt projecting from the door, and a rotary actuator coupled to a head of the threaded bolt for rotating the threaded bolt. In addition, the system includes a cross member spanning the inside of the tank and a nut secured to the cross member, where the threaded bolt and nut are positioned to engage the door to pull and secure the door over an open end of the debris tank by rotating the threaded bolt into the nut using the rotary actuator. A hinge assembly is associated with the door to mount the door to a periphery of the open end of the debris tank for swinging movement of the door between an open and a closed position.

6 Claims, 4 Drawing Sheets

FIG. 5
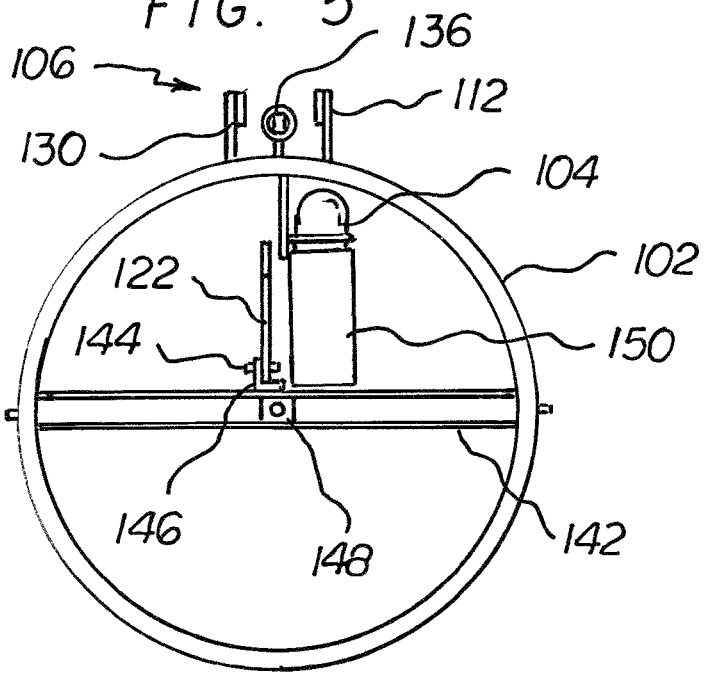
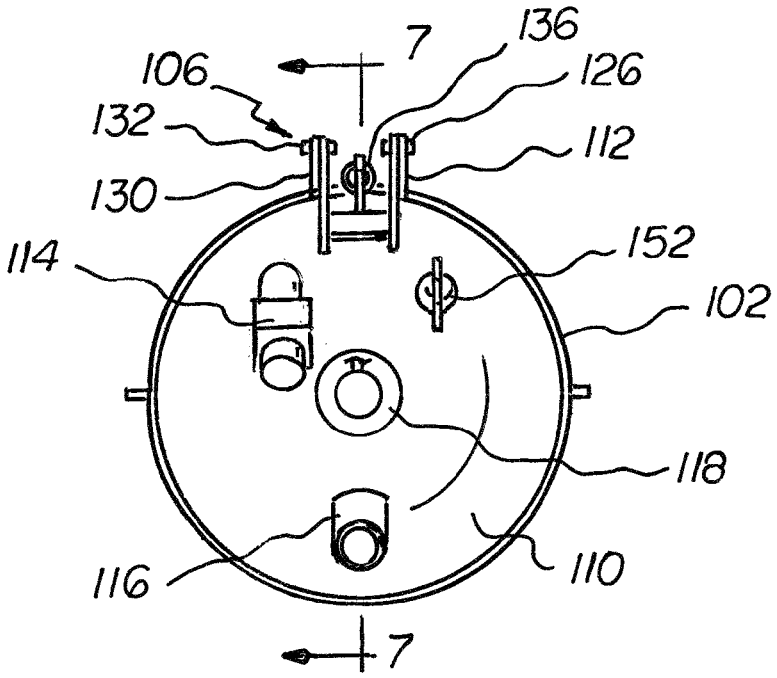
FIG. 6

DOOR LOCK SYSTEM FOR DEBRIS TANK

I. FIELD OF THE INVENTION

The present invention relates generally to a door lock system for a debris tank.

II. BACKGROUND

Industrial vacuum equipment has dozens of wet and dry uses such as hydro excavation, air excavation and vacuum excavation. In addition, the equipment can be used for directional drilling slurry removal, industrial clean-up, waste clean-up, lateral and storm drain clean-out, oil spill clean-up and other natural disaster clean-up applications. The vacuum systems may be mounted to a truck or trailer and are typically powered by gas or diesel engines.

The vacuum systems include a debris tank that is used to collect the material being suctioned by the system. A swinging type door is used over an open end of the tank to access the interior of the debris tank and also for emptying the contents of the debris tank. The door is typically locked in place using manually operated latches. Often times a pair of latches are located at opposing sides along the exterior periphery of the door. However, the latches are susceptible to leaking around the door where an airtight seal is not maintained between the door and the seal of the debris tank because of unequal pressure applied to the door by each latch. Another type of latch system that has been used in the past is located inside the debris tank. However, when the entire latching system is located inside the tank, the latches may be clogged and tangled with the debris being suctioned into the debris tank. Accordingly, what is needed is a door lock system for a debris tank that applies equal pressure to the door for an airtight seal and is reliable.

III. SUMMARY

The following presents a simplified summary of one or more embodiments in order to provide a basic understanding of some aspects of such embodiments. This summary is not an extensive overview of the one or more embodiments, and is intended to neither identify key or critical elements of the embodiments nor delineate the scope of such embodiments. Its sole purpose is to present some concepts of the described embodiments in a simplified form as a prelude to the more detailed description that is presented later.

In a particular embodiment, a door lock system for a debris tank is disclosed. The system includes a door, a threaded bolt projecting from the door, and a rotary actuator coupled to a head of the threaded bolt for rotating the threaded bolt. In addition, the system includes a cross member spanning the inside of the tank and a nut secured to the cross member, where the threaded bolt and nut are positioned to engage the door to pull and secure the door over an open end of the debris tank by rotating the threaded bolt into the nut using the rotary actuator. A hinge assembly is associated with the door to mount the door to a periphery of the open end of the debris tank for swinging movement of the door between a first position in which the door is over the open end, and a second position in which the door is spaced from the open end.

A hinge drive is coupled to the hinge assembly for driving the door between the first and second positions, where the door is positioned above the open end in a canopy orientation when in the second position. Further, the system includes a power source drivingly coupled to the hinge drive for providing power to the hinge drive, where the hinge drive is constructed and arranged such that the hinge drive drives the hinge assembly. A guide linkage having a first arm and a second arm is for coupling the cross member to the door, where the guide linkage is constructed and arranged to guide the door between the first position and the second position.

To the accomplishment of the foregoing and related ends, one or more embodiments comprise the features hereinafter fully described and particularly pointed out in the claims. The following description and the annexed drawings set forth in detail certain illustrative aspects and are indicative of but a few of the various ways in which the principles of the embodiments may be employed. Other advantages and novel features will become apparent from the following detailed description when considered in conjunction with the drawings and the disclosed embodiments are intended to include all such aspects and their equivalents.

IV. BRIEF DESCRIPTION OF THE DRAWINGS

FIG. 5 is front view of the debris tank shown in FIG. 3 taken in the direction of lines 5-5;

FIG. 6 is a front view of the door and debris tank shown in FIG. 2 taken in the direction of lines 6-6;

V. DETAILED DESCRIPTION

The word "exemplary" is used herein to mean "serving as an example, instance, or illustration." Any embodiment or design described herein as "exemplary" is not necessarily to be construed as preferred or advantageous over other embodiments or designs.

Figure 1:
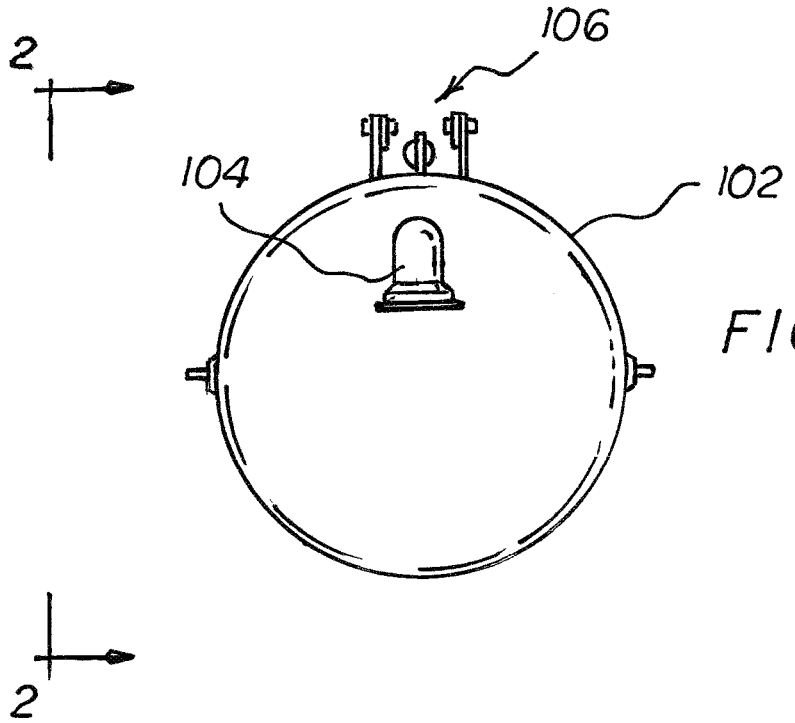
FIG. 1 is a rear elevational view of a debris tank.
Figure 2:
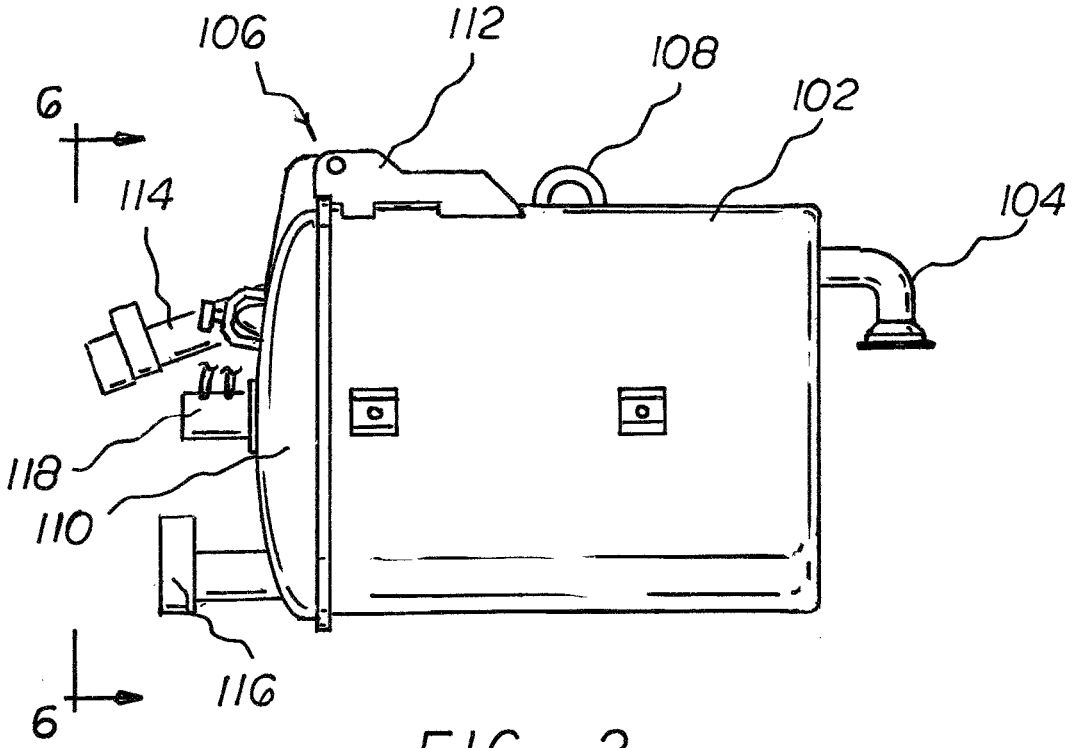
FIG. 2 is a side elevational view of the debris tank shown in FIG. 1 taken in the direction of lines 2-2.

Referring to FIGS. 1 and 2, a particular illustrative embodiment of a door lock system for a debris tank is disclosed. The debris tank 102 includes a suction port 104 that exits a closed end of the debris tank and is configured to be in communication with a pump or blower (not shown). Generally located on top of the debris tank 102 is the hinge assembly 106. A pick-up ring 108 may also be secured to the top of the debris tank 102 and can be used to move the debris tank 102 as needed. Typically, the debris tank 102 is mounted permanently to a trailer or truck. Positioned over an open end of the debris tank 102 is a door 110. The debris tank 102 is generally cylindrically shaped although other shapes may be used with the door lock system. In FIG. 2, the door is shown in the closed position over the open end of the debris tank 102. The hinge assembly 106 includes a right bracket 112 that is used, in part, to secure the hinge assembly 106 to the tank 102.

An inlet port 114 is positioned through the door 110 and is used to connect a suction hose (not shown) to the debris tank 102. In addition, a discharge port 116 traverses the door 110 and is proximate to a bottom of the debris tank 102. The discharge port 116 can be used to empty the contents of the debris tank 102. Also shown in FIG. 2 is a rotary actuator 118, which is described in greater detail below, secured to the door 110.

Figure 3:
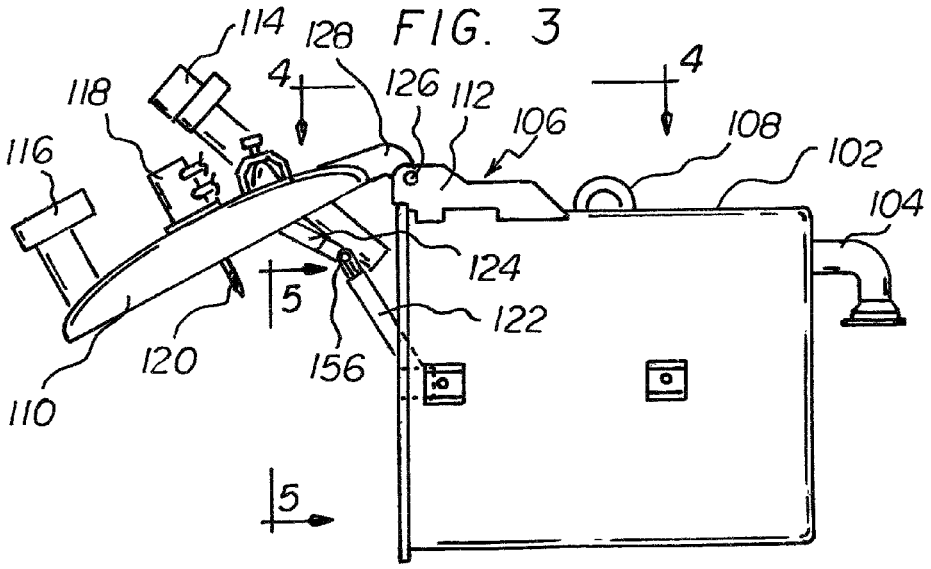
FIG. 3 is a side elevational view of the debris tank shown in FIG. 2 with the door in the opened position.

The door 110 is shown in the full open position in FIG. 3. A threaded bolt 118 is secured to the rotary actuator 118, where the threaded bolt 120 is secured to the door 110 and projects outward from the door 110. The threaded bolt 120 is configured such that it can be rotated by the rotary actuator 118. The system includes a guide linkage 122, 124 where a first arm of the guide linkage 122 is pivotally attached to a cross member mounted inside the debris tank 102 and a second arm of the guide linkage is pivotally attached to the door 110. A hinge link 156 pivotally secures the first arm 122 of the guide linkage to the second arm 124. The guide linkage 122,124 lends stability to the outwardly opening canopy configuration door 102 and biases the door 110 into the desired alignment when closing the door 110. The door 110 swings about the hinge assembly 106 mounted to the tank 102.

Figure 4:
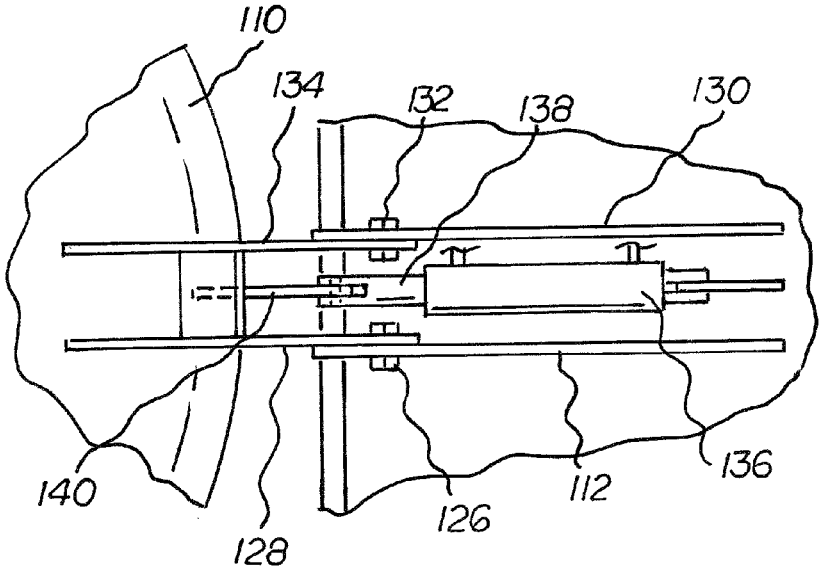
FIG. 4 is a top view of a hinge assembly associated with the door of FIG. 3 taken in the direction of lines 4-4.

A detail top view of the hinge assembly 106 is shown in FIG. 4. The hinge assembly 106 includes the right bracket 112 and a left bracket 130 mounted to the top of the debris tank 102. The brackets 112 and 130 are stationary relative to the debris tank 102. Right flange 128 and a left flange 134 are secured to the door 110 proximate a top of the door 110. The right flange 128 is pivotally attached to the right bracket 112 using right pivot pin 126. Similarly, the left flange 134 is pivotally attached to the left bracket 130 using a left pivot pine 132. Mounted between the right bracket 112 and the left bracket 130 is a hydraulic cylinder 136 having a piston rod 138. A connector 140 is fixedly attached to the door 110 and is used to pivotally attach the door 110 to the piston rod 138. Accordingly, the piston rod 138 is in an extended position when the door 110 is closed over the debris tank 102. As the piston rod 138 is retracted by the hydraulic cylinder 136, an upward force is exerted on the flanges 128, 134 to swing the door 110 upwards relative to the debris tank 102 to an open second position. Similarly, when the piston rod 138 is extended by the hydraulic cylinder 136, a reciprocal motion and force is exerted on the flanges 128, 134 to swing the door 110 downward towards the closed first position.

Referring now to FIG. 5, a cross member 142 spans the sidewalls of the debris tank 102. A nut 148 is attached to the cross member 142. Alternatively, threading may be disposed within the cross member 142. The first arm 122 of the guide linkage is attached to the cross member 142 using angle bracket 146 and pivot pin 144. Accordingly, the first arm 122 is configured to pivot as the door 110 swings open and closed. The first arm 122 guides the door 110 to align the threaded bolt 120 to the nut 148. The threaded bolt 120 may have a cone shape at its distal end to guide the threaded bolt 120 into the nut 148.

Figure 7:
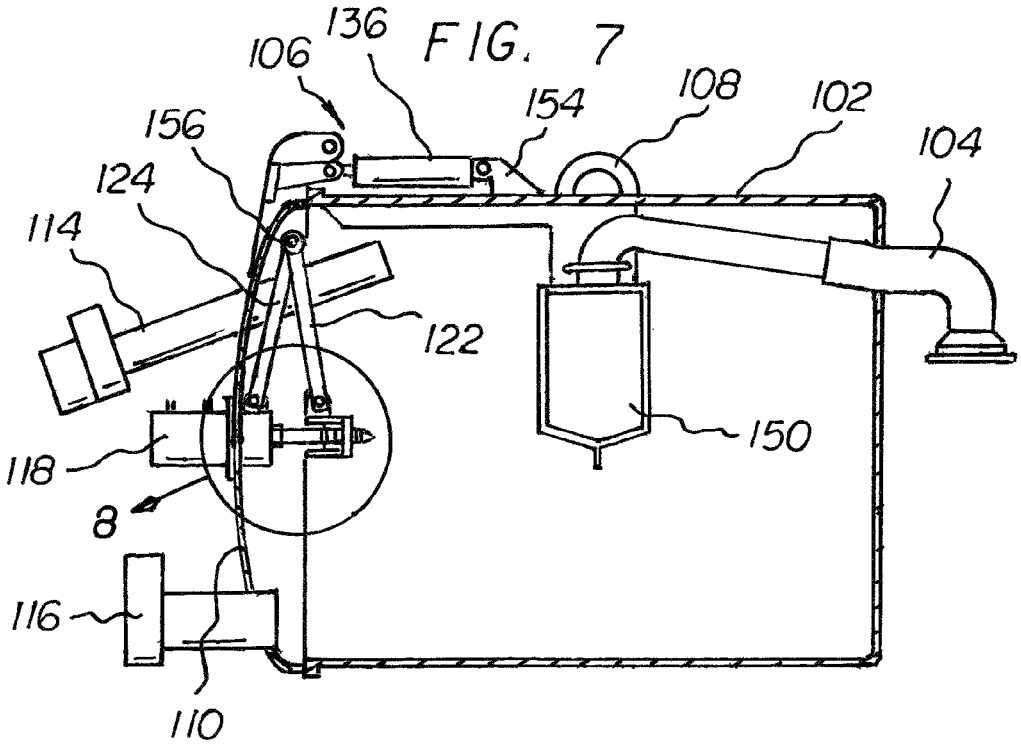
FIG. 7 is a cross sectional view of the door and the debris tank shown in FIG. 6 taken in the direction of lines 7-7.

The door 110 is shown in a closed second position in FIGS. 6 and 7. An access port 152 is provided through the door 110. The hinge assembly 106 is disposed proximate to the top of the door 110 and debris tank 102. The rotary actuator 118 is disposed generally at the center of the door 110. The door 110 is generally circular shaped to create an airtight and watertight fit to seal the door 110 over the debris tank 102. An anchor bracket 154 is used to secure the hydraulic cylinder to the debris tank 102.

Inside the debris tank 102, a float ball valve 150 is used to cut-off the vacuum when the debris tank 102 is full. In operation, as the debris tank 102 is filled with debris, the debris causes a float inside the float ball valve 150 to rise with the level of debris until the float seals an aperture at the top of the float ball valve 150. Sealing the aperture stops the suction and indicates to the operator that the debris tank 102 is full and to empty the debris tank 102. As the debris tank 102 is emptied, the float drops downward to unseal the aperture to allow the suction flow to continue once again.

Figure 8:
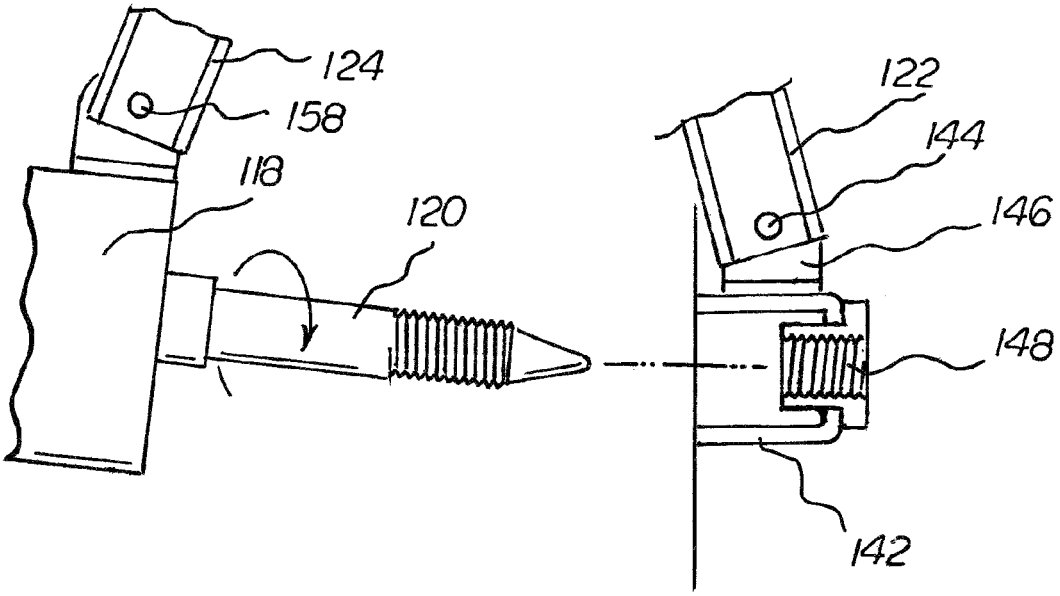
FIG. 8 is a detail view of the door lock system shown in FIG. 7.

A detail view of the threaded bolt 120 and the nut 148 is illustrated in FIG. 8. In operation, the door 110 is moved towards the closed position until the threaded bolt 120 slides into the nut 148. Once the threaded bolt 120 is seated initially into the nut 148, the rotary actuator 118 rotates the threaded bolt 120 into the complementary threads on the nut 148. Turning the threaded bolt 120 causes the threads to move the complementary nut 148 towards the threaded bolt 120. The greater the torque, or turning force, the greater the pressure pulling the nut 148 forward along the threaded bolt 120, which in turn pulls and presses the door 110 to the tank 102 creating an airtight seal. Similarly, as the threaded bolt 120 is rotated in the opposite direction, the nut 148 is pushed away from the threaded bolt 120 so that the door 110 can be moved to an open position.

The first linkage arm 122 is secured proximate to the nut 148 and includes a pivot pin positioned so that the first linkage arm cannot move laterally relative to the cross member 142. Similarly, the second linkage arm 124 is secured proximate to the threaded bolt 120 using a pivot pin 158 positioned so that the second linkage arm cannot move laterally relative to the door 110. Accordingly, as the door 110 moves between an open and closed position, the guide linkage positions the threaded bolt 120 to the nut 148.

The previous description of the disclosed embodiments is provided to enable any person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. A door lock system for hydro excavation equipment, the door lock system comprising:

a debris tank having an open end;

a door positioned over the open end;

a threaded bolt having a first end projecting from a center portion of the door into the debris tank;

a rotary actuator positioned on an exterior portion of the door coupled to a head of the threaded bolt and configured to rotate the threaded bolt;

a cross member substantially centered and spanning an inside of the debris tank;

a nut secured to the cross member, wherein the threaded bolt and nut are positioned to engage the door to pull and secure the door over the open end of the debris tank by rotating the threaded bolt into the nut using the rotary actuator;

a hinge assembly mounted to an exterior of the debris tank and coupled to the door and configured for swinging movement of the door between a first position in which the door is over the open end, and a second position in which the door is spaced from the open end; and a guide linkage mounted inside the debris tank and comprising a first arm having a first end coupled to the cross member, and a second arm having a first end coupled to a second end of the first arm and a second end coupled to the door, wherein the first end of the first arm is secured proximate to the nut and the second end of the second arm is secured on the center portion of the door proximate to the threaded bolt.

2. The system of claim 1, further comprising a hinge drive drivingly coupled to the hinge assembly for driving the door between the first and second positions.

3. The system of claim 2, wherein the door is positioned above the open end in a canopy orientation when in the second position.

4. The system of claim 3, further comprising a power source drivingly coupled to the hinge drive for providing power to the hinge drive, wherein the hinge drive is constructed and arranged such that the hinge drive drives the hinge assembly.

5. The system of claim 4, wherein the guide linkage is constructed and arranged to guide the threaded bolt into the nut.

6. The system of claim 5, wherein the door has a circular-shaped periphery.

* * * * *